US005699961A

United States Patent [19]

Ratnik et al.

[11] Patent Number: 5,699,961

[45] Date of Patent: Dec. 23, 1997

[54] FANLESS SNOW GUN

[75] Inventors: H. Ronald Ratnik, Pittsford; Timothy C. Y. Wang, Rochester, both of N.Y.

[73] Assignee: Ratnik Industries, Inc., Victor, N.Y.

[21] Appl. No.: 435,468

[22] Filed: May 5, 1995

[51] Int. Cl.[6] ..... F25C 3/04

[52] U.S. Cl. ..... 239/14.2

[58] Field of Search ..... 239/14.2, 2.2

[56] References Cited

U.S. PATENT DOCUMENTS

| | | | |
|---|---|---|---|
| 3,822,825 | 7/1974 | Dupre | 239/14.2 |
| 3,829,013 | 8/1974 | Ratnik | 239/14.2 |
| 3,964,682 | 6/1976 | Tropeano et al. | 239/14.2 X |
| 4,199,103 | 4/1980 | Dupre | 239/14.2 |
| 5,004,151 | 4/1991 | Dupre | 239/14.2 X |
| 5,083,707 | 1/1992 | Holden | 239/14.2 X |
| 5,135,167 | 8/1992 | Ringer | 239/14.2 |
| 5,322,218 | 6/1994 | Melbourne | 239/14.2 X |

*Primary Examiner*—Lesley D. Morris

*Attorney, Agent, or Firm*—Warren W. Kurz

[57] ABSTRACT

A fanless snow gun for producing man-made snow comprises one or more water nozzles for projecting a substantially conical spray of water particles into the air, and a plurality of nucleating nozzles arranged rearwardly of and at spaced locations surrounding the water nozzles for injecting ice nuclei into the water spray to effect conversion of the water particles to snow prior to descending to the ground. To compensate for the absence of an independent source of air (e.g. a motorized fan) for cooling the water particles provided by the water nozzles, the snow gun is adapted to be supported at least 20 feet above ground level to increase the particle flight time and, hence cooling time, the water particle size is limited to about 300 microns or smaller to facilitate particle cooling and conversion to ice crystals, and the ratio of ice nuclei-to-water particles in the spray is increased by at least a factor of at least two compared to the same ratio in conventional fan guns.

20 Claims, 5 Drawing Sheets

FANLESS SNOW GUN

BACKGROUND OF THE INVENTION

1. Field of the Invention

The present invention relates to improvements in apparatus for making man-made snow. More particularly, it relates to a fanless snow gun which is particularly quiet in operation and economical in terms of the volume of snow produced per unit of applied electrical power.

2. Discussion of the Prior Art

Many different devices or apparatus have been devised and used for producing "man-made" snow. Typically, such devices are found at ski resorts and operate to supplement the supply of natural snow on ski trails and surrounding areas. Virtually all types of snow-making devices produce snow by projecting water droplets into a stream of cold air, the latter serving to cool the droplets to a temperature at which they convert to ice crystals before descending to the ground. Some devices, known as "fan guns," employ a large motor-driven fan for creating the cooling air stream. In other devices, known as "snow canons" or "snow guns", the air stream is provided by a source of compressed air. The cooling air stream of a fan gun acts to enhance the water-to-snow conversion efficiency of the device by (a) creating a turbulent air flow which assists in both the droplet cooling and mixing processes, and (b) lengthening the droplet flight time or "hang time", thereby giving the droplets more time to cool and crystallize before reaching the ground.

In U.S. Pat. No. 4,711,395 issued to Louis Handfield, there is disclosed a fan gun of the type mentioned above. This fan gun is of the "central nozzle" variety in that the water droplets are introduced into the fan-produced air stream by a water nozzle located along the central axis of a barrel-shaped fan housing through which the air stream is propelled by the motor-driven fan. The water nozzle disclosed in this patent is of the type used on the hoses of fire_fighting equipment. Its output is adjustable to provide a desired throughput and spray pattern, and it includes spinning turbine teeth which act to break up the water supplied thereto into droplets of a "size ideal for snow-making". In the art, this phrase is understood to mean that the droplets are about 500–1000 microns in size because, in the case of a water nozzle of the type disclosed, i.e., the "Turbojet" (trademark) nozzle made by Akron Brass Company, the nozzle is not capable of breaking up the discharged water into droplets or particles any finer. To facilitate the conversion of such water droplets to ice crystals by the fan-produced air stream, a plurality of "nucleators" are arranged about the water nozzle and within the barrel-shaped fan housing. Each of the nucleators comprises a nozzle to which compressed air and water sources are attached. The nucleator nozzles act both to atomize the water provided thereto to produce tiny water particles (e.g. 10 microns in size) called "nuclei". The nucleator nozzles are arranged and aimed to inject their respective outputs into the swirling water/air mixture provided by the water nozzle and fan combination. Owing to their small size, the nuclei freeze first and thereby act as seeds for the further formation of ice crystals in the water/air mixture.

Depending on ambient conditions, most commercially available fan guns are advantageous in that they are capable of converting relatively large volumes of water to snow per unit time. For example, at a temperature of about 25 degrees F., most fan guns are capable of converting more than 100 gallons of water to snow per minute. But fan guns are generally considered disadvantageous from the standpoints of cost and size. More specifically, they are costly to manufacture and, owing to the motorized fan component, require considerable electrical power to operate. Also, due to the physically large fan (e.g. 18–36 inches in diameter), fan guns tend to be difficult to manipulate in order to produce snow where desired, e.g., along narrow ski trails and other difficult to reach places. Further, owing to their large size, they are awkward, at best, to support, manipulate and operate at elevated positions, such as on towers or the like. This is especially true in windy conditions. As indicated above, placement of any snow-making device at an elevated position, and in particular more than about 15 feet above ground level, has a dramatic effect on the water-to-snow conversion efficiency of the device owing to the increase in droplet flight time and, hence, the cooling time of the droplets.

There are many smaller and less costly alternatives to the fan guns discussed above, including the air/water snow guns disclosed in the commonly assigned U.S. Pat. No. 3,829,013 issued to H. R. Ratnik, and in U.S. Pat. No. 4,199,103 issued to H. K. Dupre. Rather than employing a motorized fan to effect droplet cooling, both of these snow guns use a source of compressed air to cool the droplets. In the Ratnik device, water droplets are formed in an enclosed housing before being propelled into the atmosphere by the compressed air. In the Dupre snow gun, a stream of water is sprayed into the atmosphere and a jet of compressed air, located downstream of the water spray, is used to both break up the water into small particles and convert such particles to ice crystals. While being considerably less expensive to manufacture and operate, these snow guns are generally incapable of producing the volume of snow provided by the fan guns. Further, owing to the release of compressed air, these guns operate at a relatively high and annoying noise level.

SUMMARY OF THE INVENTION

In view of the foregoing discussion, an object of this invention is to provide a fanless snow-making apparatus which, ambient conditions permitting, is capable of producing large volumes of man-made snow at a fraction of the cost associated with conventional fan gun systems and at a noise level substantially lower than that of the fanless snow guns mentioned above.

The snow-making apparatus of the invention basically comprises (a) water nozzle means for projecting a spray of water particles into the air, each of the particles having a size not substantially exceeding 300 microns; (b) nucleating means for injecting ice nuclei into the spray of water particles to effect rapid cooling of the water particles; and (c) a tower for supporting the projecting and nucleating means at an altitude sufficient to enable the water particles to be cooled by the ice nuclei to a temperature sufficient to convert such water particles to ice crystals while falling under the influence of gravity. According to a preferred embodiment of the invention, the throughput of water applied to the water nozzle means is about 50 times greater than the bulk water throughput of the nucleating means, a throughput ratio of at least twice that of conventional fan guns. This produces a ratio of ice nuclei-to-water particles which is at least twice that of the above mentioned central nozzle fan gun. As a result of this combination of elements, the fan component of the prior an apparatus can be eliminated without sacrificing snow quality, The invention will be better understood from the ensuing detailed description of preferred embodiments, reference being made to the accompanying drawings in which like reference characters denote like pans.

DETAILED DESCRIPTION OF PREFERRED EMBODIMENTS

Figure 1:
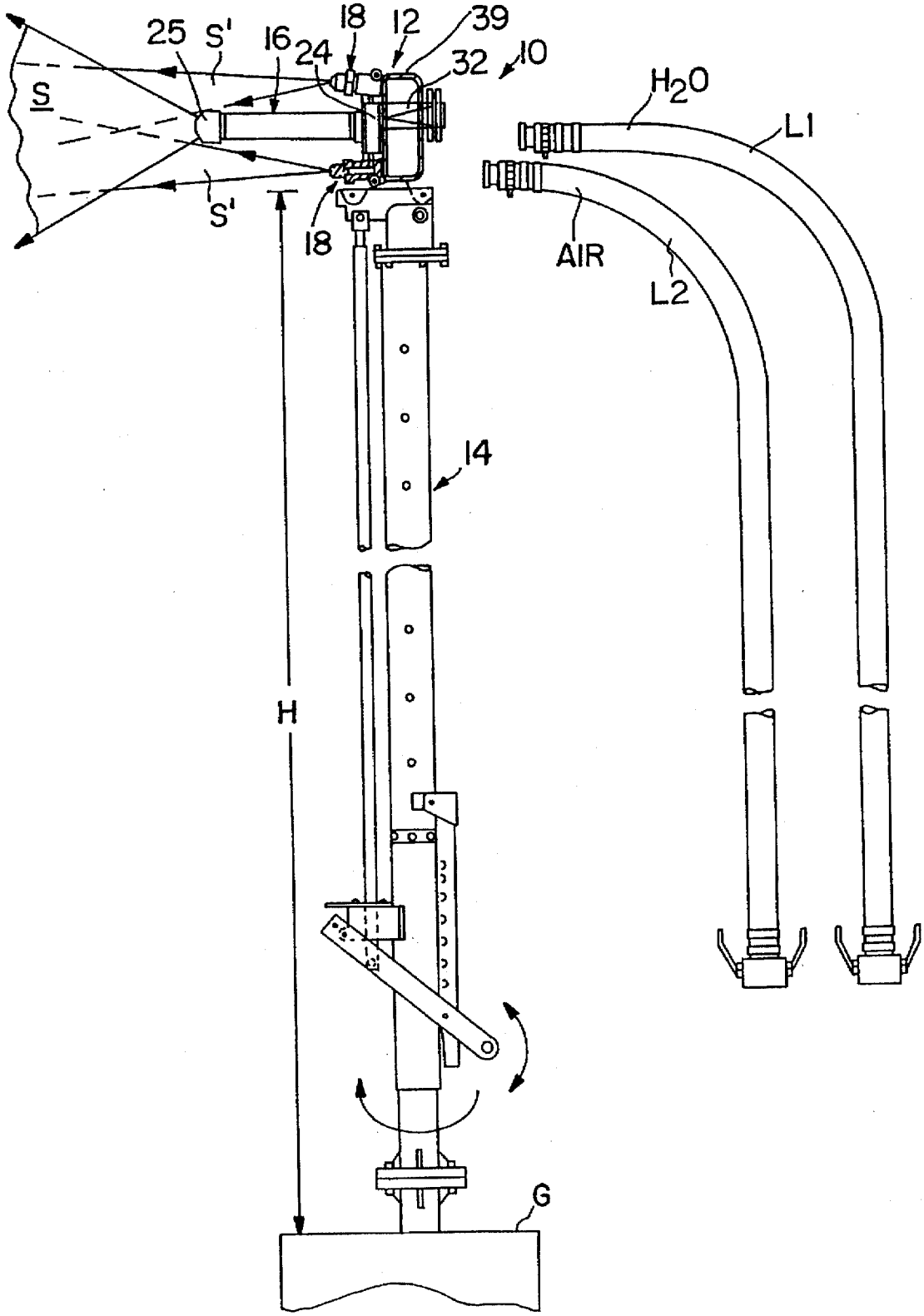
FIG. 1 is a side elevation of a preferred embodiment of the invention showing a tower-mounted fan-less snow gun.

Referring now to the drawings, FIG. 1 illustrates a tower-mounted snow-producing apparatus 10 embodying the present invention. Such apparatus generally comprises a fanless snow gun 12 mounted on an adjustable tower 14. The tower is adjustable to control the height H of the snow gun above ground level G, as well as the azimuth and elevation angle (relative to horizontal) at which the gun projects those particles which ultimately land on the ground as snow flakes. The primary purpose of the tower is to raise or elevate the snow gun to a level such that the water particles produced by the snow gun have a sufficiently long flight time to effect conversion of such particles to ice crystals, and to enable such ice crystals to combine with neighboring crystals to produce snow flakes before descending to the ground. In the fanless type of snow making apparatus disclosed, this requirement translates to a tower height of at least twenty feet, and more preferably more than 30 feet. The structural details of the tower are believed to be evident from the drawing thereby making any further description unnecessary.

Figure 2:
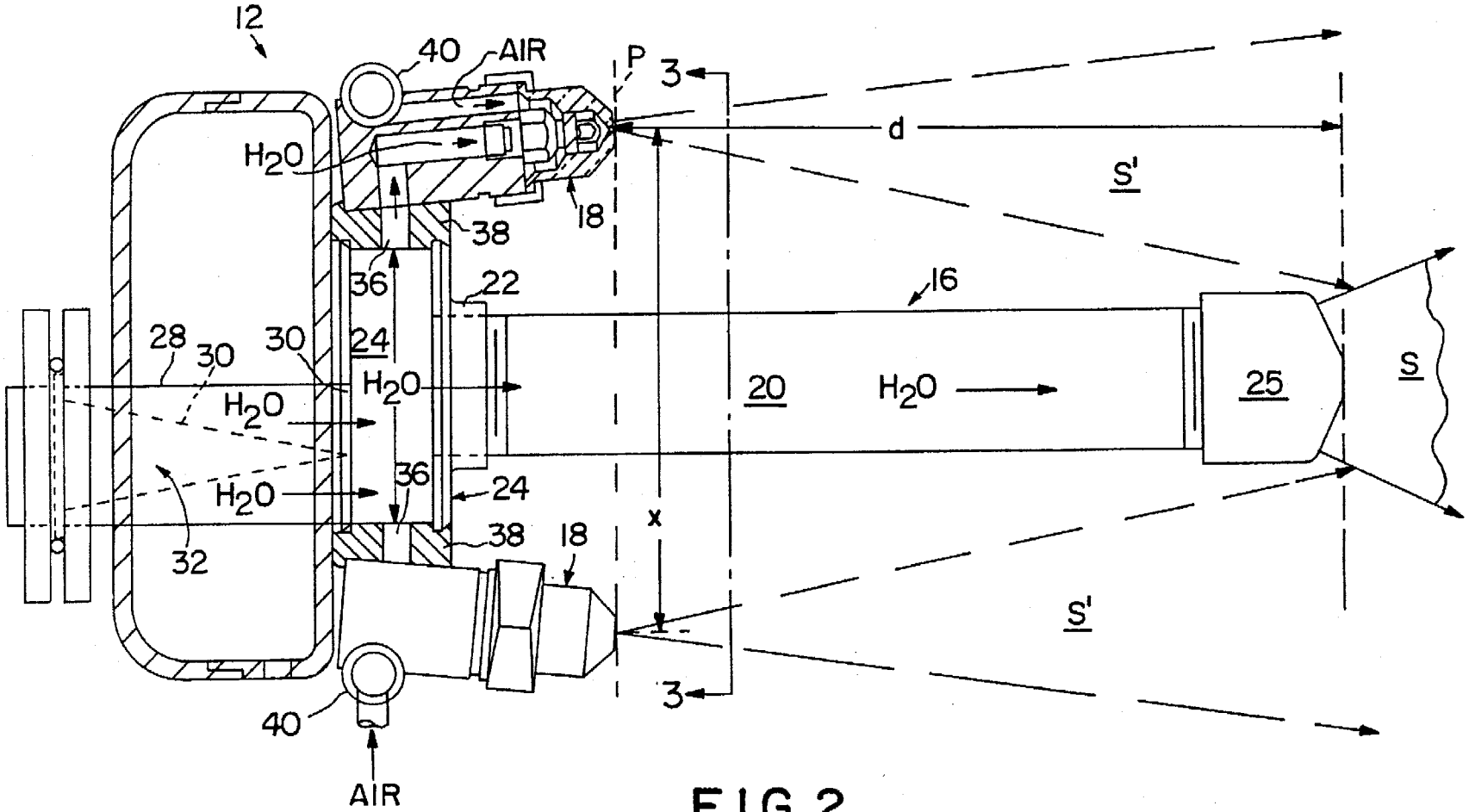
FIG. 2 is a cross-sectional view of the snow gun shown in FIG. 1.
Figure 3:
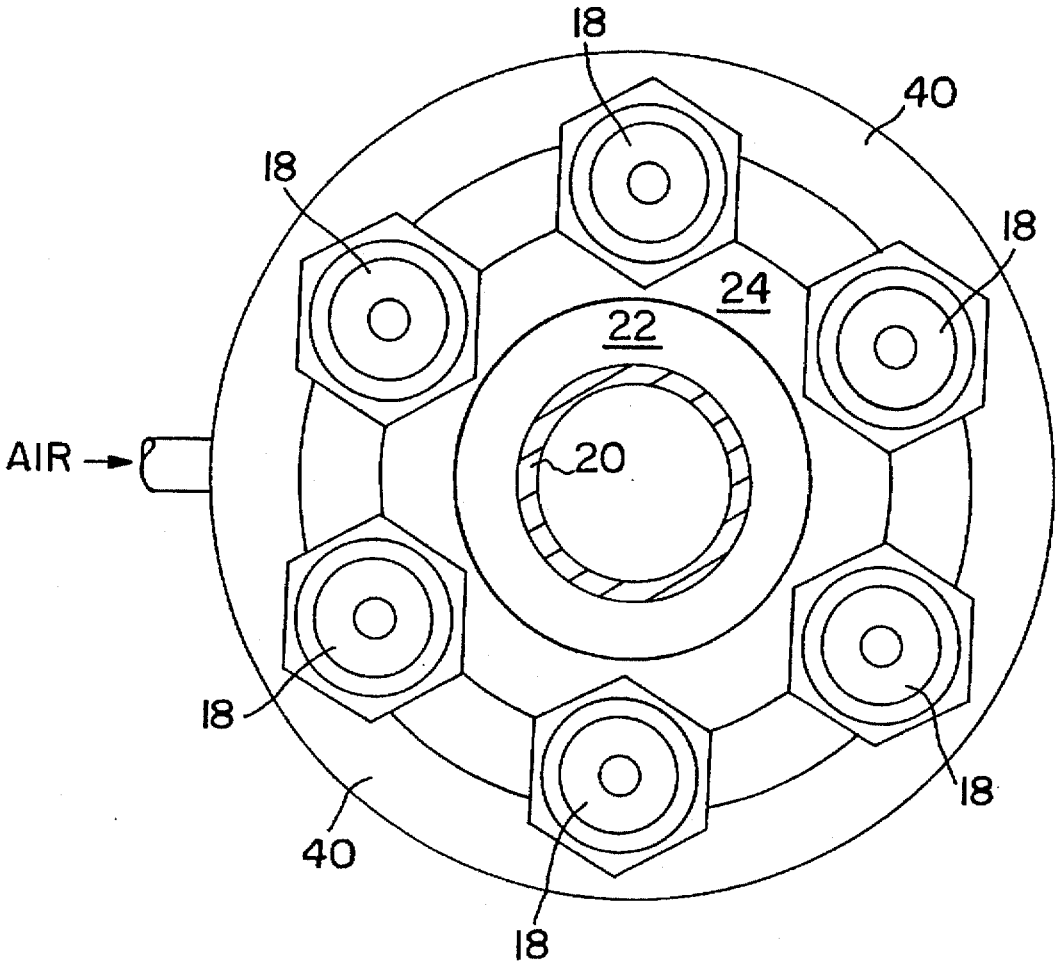
FIG. 3 is a sectional view of the nucleator portion of the FIG. 1 snow gun taken along the section line 3—3.

As better shown in FIGS. 2 and 3, snow gun 12 comprises a water nozzle assembly 16 which is centrally located with respect to a plurality of ice nucleators 18. As shown in FIG. 3, the ice nucleators are arranged in a circular configuration surrounding the water nozzle assembly. The water nozzle assembly functions to produce a substantially conical water spray S of relatively small water particles. Preferably, the cone angle of the water spray is about 60 degrees, and the water particles are of a size no larger than 300 microns, and more preferably no larger than 200 microns. As noted above, this maximum water particle size is at least two-to-five times smaller than the water particles produced by the "central nozzle" type of fan gun discussed above. The smaller particle size is necessitated by the absence of any motorized fan for accelerating the particle cooling process. Preferably, the water nozzle assembly dicharges water droplets at a rate of between 15 and 50 gallons per minute.

Ice nucleators 18 are preferably arranged relatively close to the axis of the water nozzle assembly, preferably on a circle having a diameter of between 6 and 12 inches. A preferred number of ice nucleators is six, although this number may vary from as few as one, to as many as twelve, depending on the size and desired snow making capacity of the snow gun. The ice nucleators function to inject a spray S' of ice nuclei (tiny ice crystals, about 10 microns in size) into the spray S of water particles provided by the water nozzle assembly to effect crystallization of the substantially larger water particles in the spray. Preferably, the spray S' of ice nuclei enters the spray S of water particles at a location between 3 inches and 3 feet in front of the water nozzle end. In the apparatus of the invention, the nucleation centers provided by the ice nucleators is all that is necessary to convert the water particles produced by the water nozzle assembly to ice crystals before descending to ground as snow flakes from a projection point twenty feet (or more) above ground level. Thus, it will be appreciated that the maximum allowable water particle size in spray S is that which can be converted to an ice crystal by the ice particles provided by the ice nucleators and by the prolonged particle flight time provided by the tower-mounting of the snow gun. The desired average water particle size is a trade-off between snow quality (dryness) and quantity, the larger the particles produced by the water nozzle, the greater the potential for more snow, but the greater the difficulty and cost to convert such particles to ice crystals. To partially compensate for the absence of the cooling effect provided by any fan component, the apparatus of the invention operates to inject about 2–4 times more ice nuclei into the water spray than does the fan gun described above. This increase in ice nuclei is effected by using approximately the same number of ice nucleators as a fan gun and reducing the flow rate through water nozzle assembly accordingly.

Water nozzle assembly 16 comprises a hollow pipe 20, preferably 1.5 inches in diameter. One end of pipe 20 is threaded into a threaded sleeve 22 connected to the outlet side of a water manifold 24. A cap 25 supporting a plurality of spray modules (shown in FIGS. 6A, 6B and 7A, 7B) is coupled to the free end of the pipe, preferably by a "quick-connect" coupling. By this threading and "quick-connect" arrangement, different caps beating different types of spray modules may be easily substituted for each other, the desired spray module depending on ambient conditions, and the amount of forward displacement d of the discharge end of the nozzle cap relative to the plane P of the ice nucleators may be varied (by using pipes of different lengths) to accommodate different nucleator configurations. Preferably, the forward displacement of the nozzle assembly is between about 8 and 20 inches. This amount of forward displacement assures that ice nuclei form in the nucleator spray S' before this spray reaches the water spray S.

Water under a pressure of between 100 and 600 pounds per square inch (PSI) is provided to water manifold 24 by a high pressure water line L1. The water line is "quick-connected" to a suitable fitting 28 extending from a manifold inlet 30 which is preferably formed in the bottom portion of the water manifold, as viewed in FIG. 2). By this arrangement, any water contained by the water manifold when the gun is not in use will drain out through the water line and thereby be prevented from freezing. A cone filter 32 located in fitting 28 operates to filter out any particulate material which might clog or otherwise disturb the flow of water through the nozzle assembly and nucleators. The ice nucleators are welded to the exterior of the water manifold housing and water is supplied to the nucleators through a plurality of openings 36 formed in the side wall 38 of the water manifold housing. Preferably, the nucleators collectively consume between 1 and 10 percent of the water consumed by the water nozzle assembly, and more preferably between 1 and 3 percent. By supplying water to the nucleator nozzles through a relatively large volume (e.g. 0.5 to several gallon) manifold, rather than directly through a small water conduit, any tendency for water to freeze in the nucleating nozzles is reduced. Optionally, heater coils may be inserted in the nucleator nozzles to alleviate the freeze-up problem. When such heaters are used, a shroud 39 may be used to cover and protect the heater wiring from the elements, such as ice and snow. Compressed air at about 90 PSI is supplied to the ice nucleators from a compressed air line L2 which is selectively connected to a ting-shaped conduit 40 that surrounds the outside of the nucleator assemblies. The ice nucleators are commercially available components and operate in a well known manner to combine compressed air and water to produce ice nuclei within a few inches from the respective discharge ends of the nucleator nozzles. The nucleator nozzles are aimed at the water spray S so as to inject their ice nuclei at a location as close as possible to the water nozzle cap 25 without causing ice to form on the cap itself. As indicated above, the closest distance which prevents ice build-up is about 3 inches from the nozzle cap.

Figure 5A:
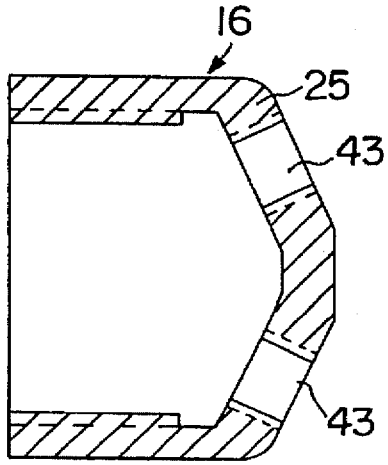
FIGS. 5A and 5B are cross section and end views of the water nozzle portion of the FIG. 1 snow gun.
Figure 5B:
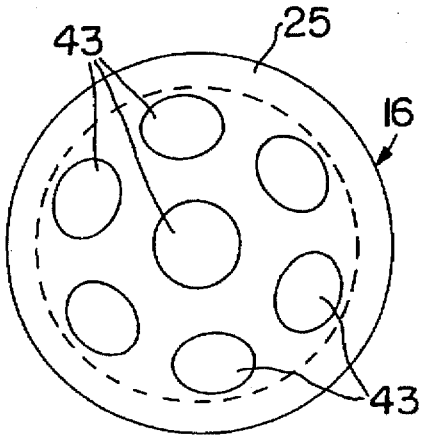
Figure 6A:
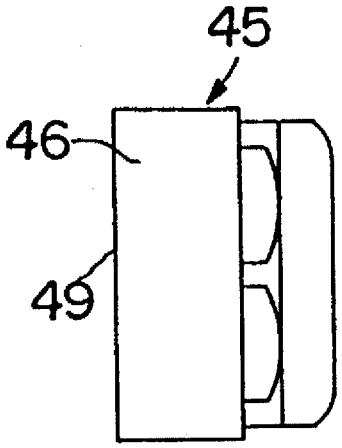
FIGS. 6A and 6B, and 7A and 7B and are side and front elevations of a preferred spray modules for the water nozzle assembly of the FIG. 1 snow gun.
Figure 6B:
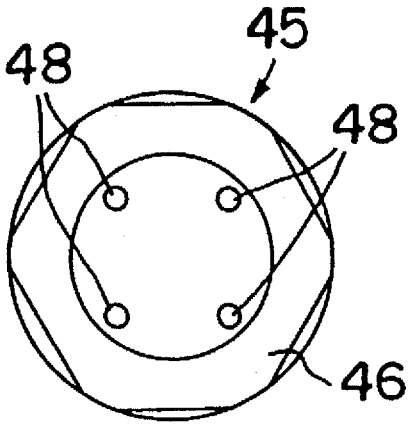
Figure 7A:
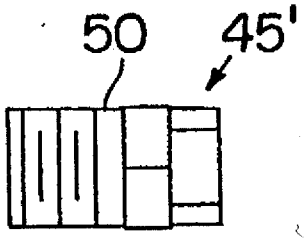
Figure 7B:
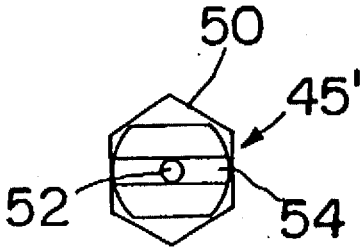

The structural details of water nozzle cap 25 are best shown in FIGS. 5A and 5B As shown, cap 25 is provided with a plurality of threaded circular holes 43 adapted to receive a like plurality of spray modules 45, 45', shown in FIGS. 6A, 6B, 7A and 7B. In FIGS. 6A and 6B, the more preferred water spray module 45 is shown to comprise a threaded hollow housing 46 having four circular jet holes 48 formed therein. Each of the jet holes has a diameter of about 0.08 inch, and each hole is adapted to proce a hollow conical spray having a cone angle of 60 degrees when pressurized water is applied to the rear side 49 of the housing. Each water spray module provides a water throughput of about 3.40 gallons per minute when water at a pressure of 100 PSI is applied thereto. The nozzle assembly throughput may be adjusted by adding or subtracting spray modules to cap 25, each module eliminated being replaced by a solid threaded plug. Water spray modules of the type shown in FIGS. 6A and 6B are commercially available from Techno Alpin, in Bolzano, Italy. An alternative water spray module is shown in FIGS. 7A and 7B. Each nozzle module comprises a hollow threaded body 50 having a single jet hole 52 about 0.14 inch in diameter. Hole 52 is centrally located in a slot 54 whereby a flat fan spray is produced. Preferably, such a module is adapted to provide a 40 degree fan spray with a throughput of about 3.9 gallons per minute at a water pressure of 100 PSI. Water spray modules of this type are available from Lechler Inc., in St Charles, Ill.

Figure 4:
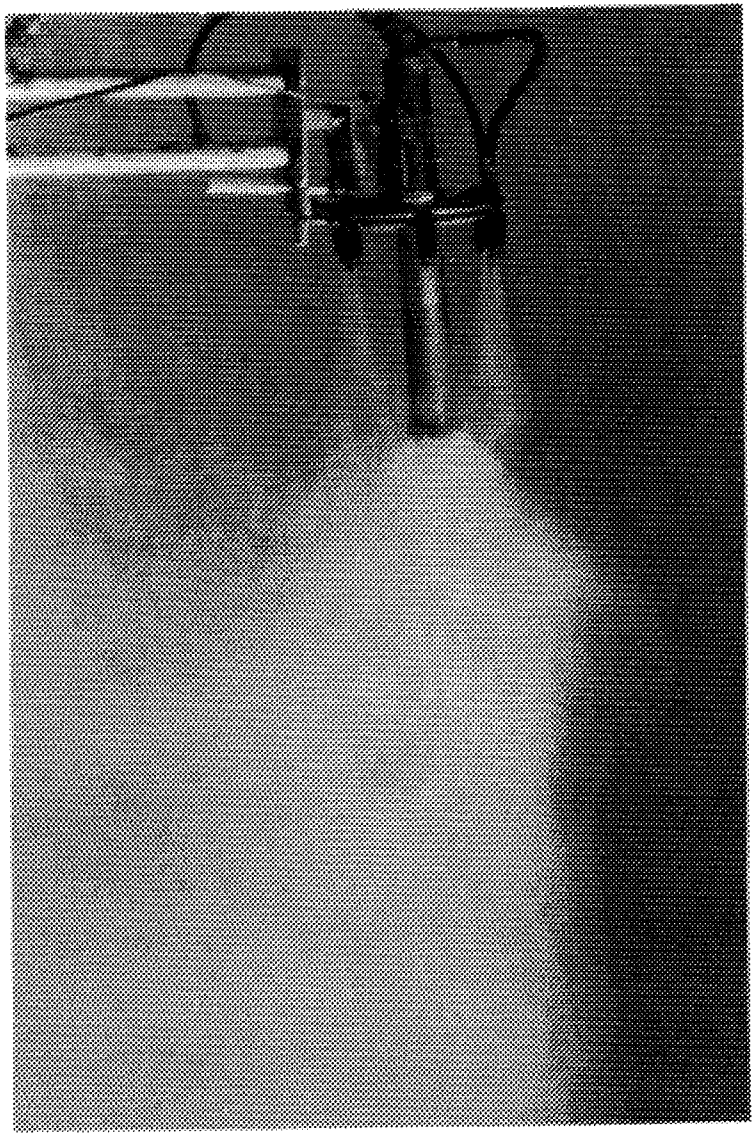
FIG. 4 is a photograph of the FIG. 1 snow gun in operation.

In the photograph of FIG. 4, a prototype of the fanless snow-making apparatus described above is shown in operation. In this version, the water manifold 24 shown in FIGS. 1 and 2 has been replaced with a second ring-shaped conduit (the first ring-shaped conduit providing compressed air) for supplying water to the nucleating nozzles. Also, the water nozzle assembly is somewhat different in appearance, nozzle cap 25 of the FIGS. 1 and 2 apparatus being replaced by a cluster of spray modules which are integral with pipe 20. Nevertheless, the concept of using a plurality of ice nucleators to crystallize a spray of relatively small water particles (300 micron or smaller) to produce snow from a tower-mounted gun is shown to work.

Compared to fan guns of the type mentioned above, the fanless snow-making apparatus shown in FIG. 1 cannot produce the same volume of snow per unit time. However, owing to its comparatively small size (made possible by absence of any motorized fan components and the relatively close spacing between the water nozzle assembly and the ice nucleators), two or three of the fanless snow guns shown in FIG. 2 may be mounted on the same tower platform to produce a comparable volume of snow. More importantly, the snow gun of the invention is significantly more efficient than many types of snow guns in making snow. Consider, for example, that a conventional compressed air/water gun typically requires about 210 cubic feet of air per minute (CFM) to convert 25 gallons of water per minute to snow. This translates to approximately 50 horse power of energy. In contrast, the fanless snow gun of FIG. 2 uses only about 25 CFM of compressed air to convert the same amount of water to snow at the same ambient temperature and relative humidity. This translates to about 6 horse power of energy and represents an eight-fold increase in energy efficiency. Further, compared to conventional air/water guns, the snow-making apparatus of the invention is substantially more quiet since it uses only a fraction of the compressed air required by such guns.

While the invention has been described with reference to a particularly preferred embodiment, various modifications can be made without departing from the spirit of the invention, and such modifications are intended to fall within the scope of the appended claims.

What is claimed is:

1. A fanless snow-making apparatus comprising:

(a) water projecting means for projecting a spray of water particles into the air, each of said particles having a size not substantially greater than 300 microns;

(b) nucleating means for injecting ice particles into said spray, said ice particles serving as nucleation centers about which said water particles freeze and form ice crystals, said nucleating means comprising a housing for mixing compressed air and water to produce said ice particles, said nucleating means consuming between about 1 and 10 percent of the water consumed by said water protecting means; and (c) a tower for supporting said water projecting and nucleating means at an altitude sufficient to enable said water particles to be converted to ice crystals while falling under the influence of gravity.

2. The apparatus as defined by claim 1 wherein said water projecting means comprises a water nozzle assembly having an input end adapted to be connected to a source of water under pressure, said nozzle assembly including means for breaking up water provided thereto by said source water to particle sizes smaller than 300 microns and for projecting said particles through a discharge end of said water nozzle assembly.

3. The apparatus as defined by claim 2 wherein said water nozzle assembly comprises a cap member having a plurality of openings for supporting a like plurality of nozzle modules, each nozzle module having a plurality of jet holes for producing a like plurality of conical sprays of water particles having sizes smaller than 300 microns.

4. The apparatus as defined by claim 2 wherein said nucleating means comprises a plurality of nucleating nozzles having respective discharge ends for projecting ice nuclei, said ends arranged in a common plane, each of said nucleating nozzles being adapted to be simultaneously connected to respective sources of compressed air and water under pressure, said nozzles being adapted to utilize compressed air and pressurized water provided thereto by said sources to produce a spray of ice nuclei within about one foot from the respective discharge ends of said nucleating nozzles, said spray of ice nuclei being directed at the discharge end of said water nozzle.

5. The apparatus as defined by claim 4 wherein the discharge end of said water nozzle is positioned between about 8 and 20 inches forward of the plane of said nucleating nozzles.

6. The apparatus as defined by claim 4 wherein said nucleating nozzles are equally spaced from each other.

7. The apparatus as defined by claim 4 wherein the spacing between the discharge end of said water nozzle and the plane of said nucleating nozzles is adjustable.

8. The apparatus as defined by claim 1 wherein said projecting means and said nucleating means consume water from a pressurized source in producing said spray of water particles and said ice nuclei, and wherein said nucleating means consumes between about 1 and 3 percent of the water consumed by said water projecting means.

9. The apparatus as defined by claim 1 wherein said water projecting means has a throughput of between 15 and 50 gallons per minute.

10. The apparatus as defined by claim 3 wherein said nucleating means operates to inject said ice nuclei into said spray of water particles at a location within about 3 feet from the discharge end of said nozzle assembly.

11. A tower-mountable fanless snow gun comprising;

(a) water projecting means for projecting a spray of water particles into the air, each of said particles having a size not substantially greater than 300 microns; and (b) nucleating means for injecting ice nuclei into said spray to effect conversion of said water particles to ice crystals, said ice nuclei having a size of about 10 microns.

12. The apparatus as defined by claim 11 wherein said water projecting means comprises a water nozzle assembly having an input end adapted to be connected to a source of water under pressure, said water nozzle assembly including means for breaking up water provided thereto by said source to water to particle sizes less than 300 microns and for projecting said particles through a discharge end of said water nozzle assembly.

13. The apparatus as defined by claim 12 wherein said water nozzle assembly comprises a cap member having a plurality of openings for supporting a like plurality of nozzle modules, each nozzle module having a plurality of jet holes for producing a like plurality of conical sprays of water particles having sizes smaller than 300 microns.

14. The apparatus as defined by claim 11 wherein said nucleating means comprises a plurality of nucleating nozzles having respective discharge ends for projecting ice nuclei arranged in a common plane, each of said nucleating nozzles being adapted to be simultaneously connected to respective sources of compressed air and water under pressure, said nozzles being adapted to utilize compressed air and pressurized water provided thereto by said sources to produce a spray of ice nuclei within about one foot from the respective discharge ends of said nucleating nozzles, said spray of ice nuclei being directed at the discharge end of said water nozzle.

15. The apparatus as defined by claim 14 wherein the discharge end of said water nozzle is positioned between about 12 and 20 inches forward of the plane of said nucleating nozzles.

16. The apparatus as defined by claim 14 wherein said nucleating nozzles are equally spaced from each other.

17. The apparatus as defined by claim 14 wherein the spacing between the discharge end of said water nozzle and the plane of said nucleating nozzles is adjustable.

18. The apparatus as defined by claim 11 wherein said projecting means and said nucleating means consume water from a pressurized source in producing said spray of water particles and said ice nuclei, and wherein said nucleating means consumes between about 4 and 10 percent of the water consumed by said water projecting means.

19. The apparatus as defined by claim 18 wherein said water projecting means has a throughput of between 15 and 50 gallons per minute.

20. The apparatus as defined by claim 12 wherein said nucleating means operates to inject said ice nuclei into said spray of water particles at a location within about 3 feet from the discharge end of said water nozzle assembly.

* * * * *